US010302386B2

(12) United States Patent
Heninger

(10) Patent No.: US 10,302,386 B2
(45) Date of Patent: May 28, 2019

(54) DEVICE FOR CLEANING AND LOADING A MUZZLE LOADING RIFLE

(71) Applicant: William R. Heninger, Ogema, WI (US)

(72) Inventor: William R. Heninger, Ogema, WI (US)

( * ) Notice: Subject to any disclaimer, the term of this patent is extended or adjusted under 35 U.S.C. 154(b) by 0 days.

(21) Appl. No.: 15/932,988

(22) Filed: Jun. 5, 2018

(65) Prior Publication Data

US 2018/0356180 A1 Dec. 13, 2018

Related U.S. Application Data

(60) Provisional application No. 62/603,844, filed on Jun. 12, 2017.

(51) Int. Cl.

| | |
|---|---|
| ***F41A 29/00*** | (2006.01) |
| ***F41C 9/08*** | (2006.01) |
| ***F41A 23/18*** | (2006.01) |
| ***F41C 33/00*** | (2006.01) |

(52) U.S. Cl.
CPC ..... *F41C 9/085* (2013.01); *F41A 23/18* (2013.01); *F41A 29/00* (2013.01); *F41C 33/003* (2013.01)

(58) Field of Classification Search
CPC ..... F41C 33/003; F41C 33/005; F41C 33/06; F41C 9/085; F41A 29/00; F41A 23/18
USPC ..... 42/94, 95; 224/149, 913
See application file for complete search history.

(56) References Cited

U.S. PATENT DOCUMENTS

| | | | | |
|---|---|---|---|---|
| 2,783,896 | A * | 3/1957 | Agostini | B60R 7/14 211/64 |
| 3,477,586 | A * | 11/1969 | Haluska | A47B 81/005 211/64 |
| 5,078,279 | A * | 1/1992 | Hancock | A47B 81/005 211/64 |
| 7,124,530 | B1 | 10/2006 | Clark | |
| 8,444,034 | B2 | 5/2013 | Bennett | |
| 2018/0015894 | A1* | 1/2018 | Zaldivar Ortiz | B60R 16/0215 |

* cited by examiner

*Primary Examiner* — Stephen Johnson
(74) *Attorney, Agent, or Firm* — Timothy S. Stevens; Karen L. Kimble

(57) ABSTRACT

A device for cleaning and/or loading a muzzle loading rifle. The device includes: (a) a beam, (b) a clamp, (c) an upper cradle, (d) a lower cradle; and (e) a retainer. The clamp is attached to the beam so that the beam can be clamped to an object with the longitudinal axis of the beam being vertical. The upper cradle is attached to an upper portion of the beam when the beam is clamped to an object, the lower cradle is attached to a lower portion of the beam when the beam is clamped to an object so that a muzzle loading rifle can be cradled and retained to the device with the muzzle of the rifle pointing up so that the rifle can be cleaned and/or loaded.

6 Claims, 3 Drawing Sheets

DEVICE FOR CLEANING AND LOADING A MUZZLE LOADING RIFLE

BACKGROUND OF THE INVENTION

The instant application claims priority to Provisional application 62/603,844, filed Jun. 12, 2017. The instant invention relates to the cleaning and/or loading of a muzzle loading rifle. Traditionally, a muzzle loading rifle is cleaned and loaded by hand by placing the butt of the rifle on the ground and passing a ramrod down the muzzle. If the rifle is leaned against a bench, tree or the tailgate of a truck, then there is the possibility that the rifle could slip and fall to the ground. Thus, there is a need for a device useful for securely and safely holding a muzzle loading rifle when said rifle is cleaned and/or loaded.

SUMMARY OF THE INVENTION

The instant invention is an important advance in the field of cleaning and/or loading a muzzle loading rifle. The instant invention is device useful for securely and safely holding a muzzle loading rifle when said rifle is cleaned and/or loaded. The instant invention can be clamped to a support such as the tailgate of a pickup truck so that a muzzle loading rifle can be secured for cleaning and/or loading. More specifically, the instant invention is a device for cleaning and/or loading a muzzle loading rifle, comprising: (a) a beam, (b) a clamp, (c) an upper cradle, (d) a lower cradle; and (e) a retainer, the clamp attached to the beam so that the beam can be clamped to an object with the longitudinal axis of the beam being vertical, the upper cradle attached to an upper portion of the beam when the beam is clamped to an object, the lower cradle attached to a lower portion of the beam when the beam is clamped to an object so that a muzzle loading rifle can be cradled and retained to the device with the muzzle of the rifle pointing up so that the rifle can be cleaned and/or loaded.

DETAILED DESCRIPTION OF THE INVENTION

Figure 1:
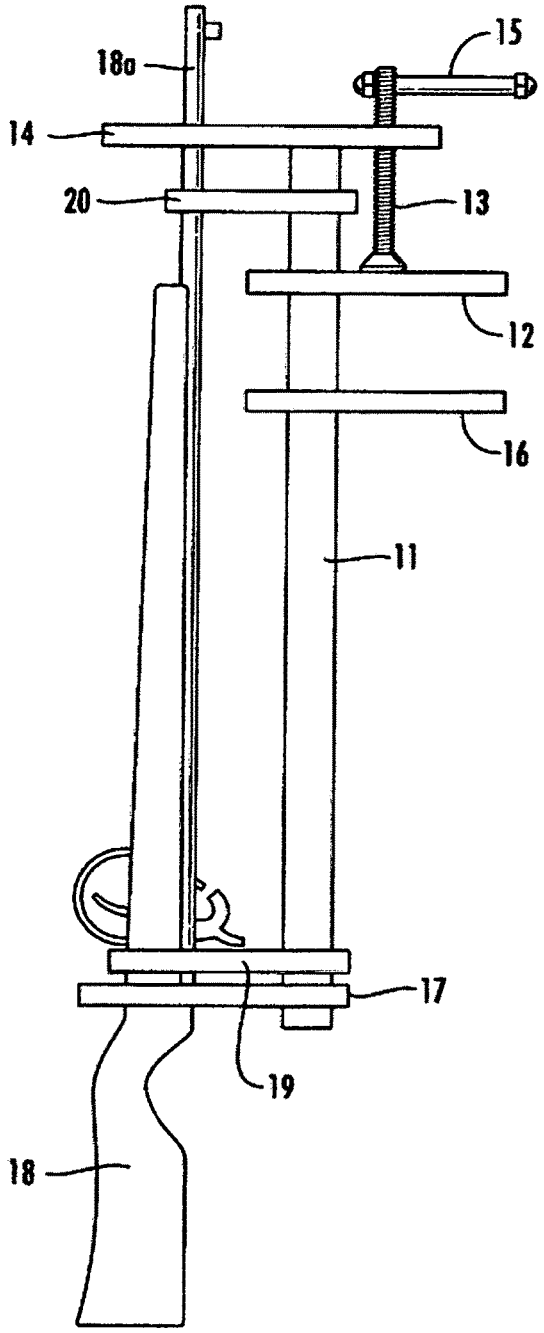
FIG. 1 is a side view of a highly preferred device of the instant invention holding a muzzle loading rifle.
Figure 2:
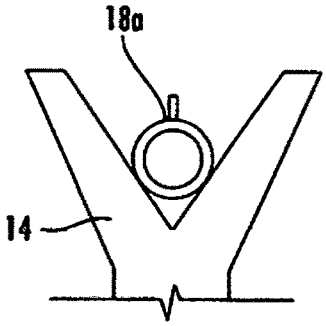
FIG. 2 is a top view of the device shown in FIG. 1 showing a portion of the upper V rest of the device and the muzzle of the rifle.

Referring now to FIG. 1, therein is shown a side view of many of the key features of device of the instant invention comprised of beam 11, upper jaw 12, screw 13, upper V rest 14, screw handle 15, lower jaw 16, lower V rest 17, muzzle loading rifle 18 having barrel 18*a*, lower retention band 19 and upper retention band 20. Bands 19 and 20 comprise the VELCRO brand hook and loop system to retain rifle 18 to the device. Upper V rest 14 and lower U rest 17 serve as cradles for rifle 18. FIG. 2 is a top view of a portion of upper V rest 14 and barrel 18*a* of rifle 18. Screw 13 engages with an extension of upper V rest 14. Upper jaw 12, lower jaw 16, screw 13 and screw handle 15 form a clamp for clamping the device to, for example, the tailgate of a pickup truck.

Figure 3:
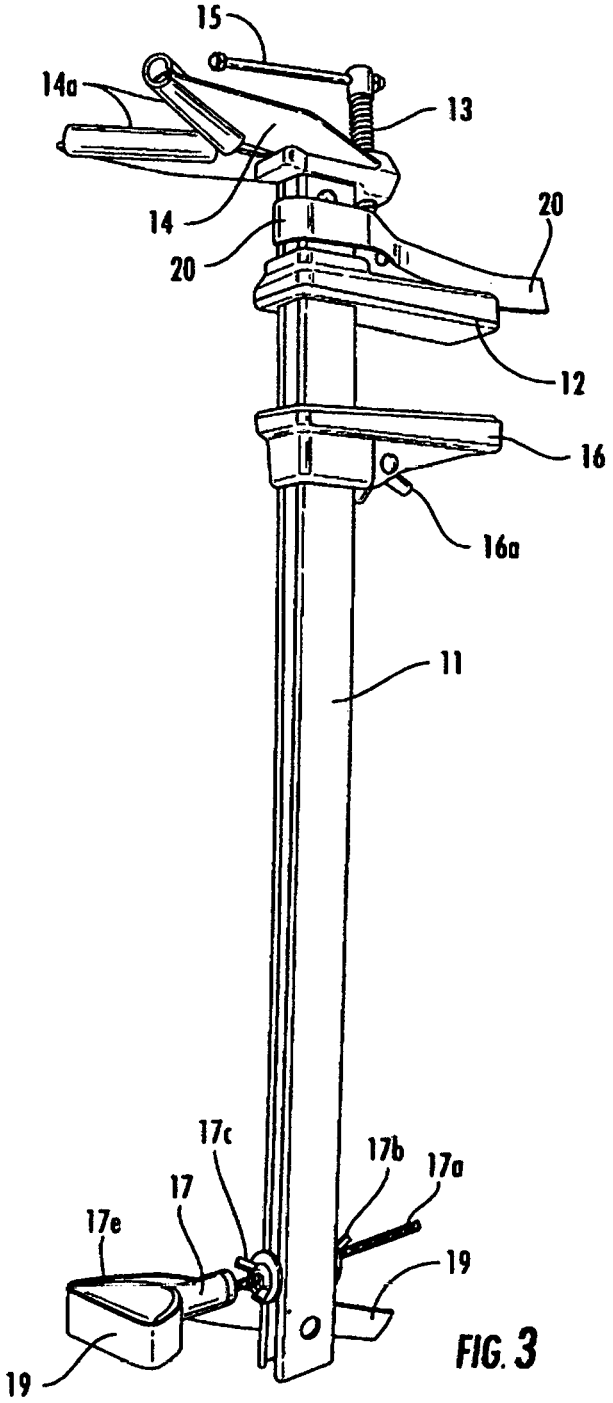
FIG. 3 is a perspective drawing of a highly preferred device of the instant invention.
Figure 4:
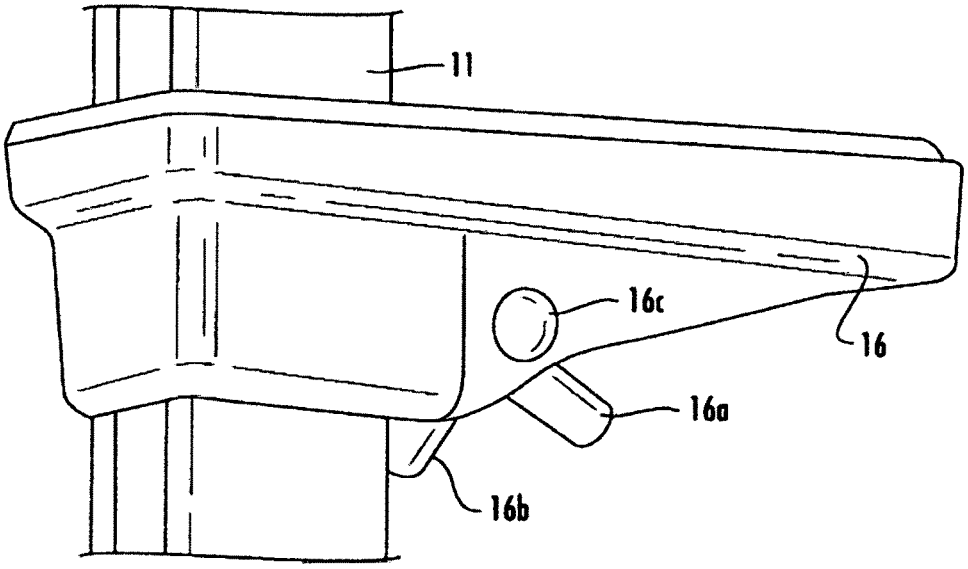
FIG. 4 is perspective drawing showing details of the device shown in FIG. 3.

Referring now to FIG. 3, therein is shown a perspective view of a highly preferred embodiment of the instant invention. Beam 11 is made of fiber reinforced polycarbonate resin. V-rest 14 is adjustable in and out two inches from the longitudinal axis of beam 11. Plastic tubing 14*a* is provided to prevent marring of the barrel of a rifle held in V rest 14 by retention band 20. Upper jaw 12 slides along the longitudinal axis of beam 11 by turning screw 13 by way of screw handle 15. Referring now to FIG. 4, therein is shown lower jaw 16 comprising spring biased saw toothed catch 16*b* pivoting on pin 16*c*. When lever 16*a* is pressed, the teeth of catch 16*b* disengage from beam 11 so that lower jaw 16 can be slid along the longitudinal axis of beam 11. When lever 6*a* is released, the teeth of catch 16*b* engage with beam 11 to hold lower jaw 16 against, for example, the underside of a lowered tailgate of a pickup truck. Then, referring again to FIG. 3, upper jaw 12 can be tightened against the upper side of said tailgate of the pickup truck by turning screw 13 using handle 15. Lower U rest 17 is comprised of threaded rod 17*a*, wing nuts 17*b* and 17*c* and rubber cushioned U portion 17*e*. Retention band 19 us used to hold the butt stock of a rifle in U rest 17. U rest 17 is adjustable in and out from the longitudinal axis of beam 11 by way of threaded rod 17*a* and wing nuts 17*b* and 17*c*. Beam 11 comprises holes bored across beam 11 at one inch intervals to that U rest 17 can be positioned up or down the longitudinal axis of beam 11. Upper jaw 12 and lower jaw 16 are preferably faced with cushioning pads made of, for example, rubber or plastic. Beam 11 is preferably about thirty inches long.

The components of the instant invention can be made of any suitable material. The object to which the device of the instant invention is clamped can for example, and without limitation thereto, be the tailgate of a pickup truck, a fence rail, the rail of a hunting stand or the side of a shooting range bench.

CONCLUSION

While the instant invention has been described above according to its preferred embodiments, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains.

What is claimed is:

1. A device for cleaning and/or loading a muzzle loading rifle, comprising: (a) a beam, the beam having a longitudinal axis (b) a clamp, (c) an upper cradle, (d) a lower cradle; (e) an upper retainer; and (f) a lower retainer, the clamp comprising an upper jaw adjustably attached to the beam and a spaced apart lower jaw attached to the beam so that the upper jaw can be adjusted along the longitudinal axis of the beam toward the lower jaw to clamp onto an object so that the beam can be clamped to the object with the longitudinal axis of the beam being vertical, the upper cradle attached to an upper portion of the beam when the beam is clamped to the object, the lower cradle attached to a lower portion of the beam when the beam is clamped to the object so that the muzzle loading rifle can be retained to said upper and lower cradles of said device by said upper and lower retainers with the muzzle of the muzzle loading rifle pointing up so that the muzzle loading rifle can be cleaned and/or loaded by way of the muzzle of the muzzle loading rifle.

2. The device of claim 1, wherein the beam comprises a fiber reinforced polymer composition.

3. The device of claim 2, wherein the fiber reinforced polymer composition is glass fiber reinforced polycarbonate polymer.

4. The device of claim 1, wherein the upper cradle has a V shape while the lower cradle has a U shape.

5. The device of claim 2, wherein the upper cradle has a V shape while the lower cradle has a U shape.

6. The device of claim 3, wherein the upper cradle has a V shape while the lower cradle has a U shape.

* * * * *